US008833589B2

(12) United States Patent
Vovan

(10) Patent No.: US 8,833,589 B2
(45) Date of Patent: Sep. 16, 2014

(54) ENHANCED TAMPER EVIDENT BOWL WITH BLOCKED TAB

(75) Inventor: Terry Vovan, Rialto, CA (US)

(73) Assignee: Pactiv Packaging Inc., Lake Forest, IL (US)

( * ) Notice: Subject to any disclaimer, the term of this patent is extended or adjusted under 35 U.S.C. 154(b) by 1506 days.

(21) Appl. No.: 11/315,654

(22) Filed: Dec. 21, 2005

(65) Prior Publication Data

US 2007/0138180 A1 Jun. 21, 2007

(51) Int. Cl.

| | |
|---|---|
| ***B65D 41/32*** | (2006.01) |
| ***B65D 43/02*** | (2006.01) |
| *B65D 43/16* | (2006.01) |

(52) U.S. Cl.

CPC ..... *B65D 43/021* (2013.01); *B65D 43/162* (2013.01); *B65D 2543/00194* (2013.01); *B65D 2543/00296* (2013.01)

USPC ..... 220/266; 220/4.23; 220/281; 220/789; 220/849; 220/835

(58) Field of Classification Search

CPC ..... B65D 43/021; B65D 43/162; B65D 2101/0015; B65D 2543/00194; B65D 2543/00296; B65D 2543/00842; B65D 2543/00509; B65D 2543/0062; B65D 2543/00685; B65D 2543/00731; B65D 2543/00796; B65D 2543/0037

USPC ..... 220/4.23, 281, 789, 849, 839, 835, 266, 220/4.21, 791

See application file for complete search history.

(56) References Cited

U.S. PATENT DOCUMENTS

| | | | |
|---|---|---|---|
| 1,988,280 | A | 1/1935 | Levkoff |
| 2,567,013 | A | 9/1951 | Feinberg |
| 2,701,053 | A | 2/1955 | Tamarin |

(Continued)

FOREIGN PATENT DOCUMENTS

| | | |
|---|---|---|
| DE | 7816353 | 11/1978 |
| DE | 4418935 | 12/1995 |

(Continued)

OTHER PUBLICATIONS

U.S. Appl. No. 11/879,168, Non-Final Rejection dated Jun. 10, 2010.

(Continued)

*Primary Examiner* — Anthony Stashick
*Assistant Examiner* — James M Van Buskirk
(74) *Attorney, Agent, or Firm* — Baker Botts L.L.P.

(57) ABSTRACT

A container which includes a base (12) that can hold food and a lid (14) that closes on the base, which clearly indicates if the lid has been opened after a clerk loaded food into the base and closed the lid. The base and lid each have trapping portions (20, 22) and pull-open portions (24, 32) with a tear-tab, or tear-open barrier (80). To close the lid, a clerk projects a tab (30) on the pull-open portion of the lid through a slot (26) in the pull-open portion of the base, and then presses down the entire trapping portion of the lid into the trapping portion of the base. The lid cannot be lifted up because the tear-open barrier (80) forming the top wall of the slot lies over the tab. To open the container, a person must tear the barrier so he/she can pull up the tab 30 and open the lid. The fact that the barrier has been torn is obvious.

18 Claims, 7 Drawing Sheets

(56) References Cited

U.S. PATENT DOCUMENTS

| | | | | |
|---|---|---|---|---|
| 3,572,579 | A | 3/1971 | Mueller | |
| 3,773,207 | A | 11/1973 | Dokoupil et al. | |
| 3,860,148 | A | 1/1975 | Sherin | |
| 3,933,296 | A | 1/1976 | Ruskin et al. | |
| 3,941,248 | A | 3/1976 | Moser et al. | |
| 3,955,742 | A | 5/1976 | Marshall et al. | |
| 3,984,025 | A | 10/1976 | Khoury | |
| 4,060,176 | A | 11/1977 | Tobiasson | |
| 4,113,136 | A | 9/1978 | Abbott | |
| 4,139,121 | A | 2/1979 | Roccaforte | |
| 4,262,814 | A | 4/1981 | Roccaforte | |
| 4,520,943 | A | 6/1985 | Nielsen | |
| 4,555,043 | A | 11/1985 | Bernhardt | |
| 4,560,082 | A | 12/1985 | Sutch | |
| 4,569,443 | A | 2/1986 | Roccaforte | |
| 4,610,371 | A | 9/1986 | Karkiewicz | |
| 4,627,550 | A | 12/1986 | Dines | |
| 4,671,453 | A | 6/1987 | Cassidy | |
| 4,721,210 | A * | 1/1988 | Lawrence et al. | 206/459.1 |
| 4,742,935 | A | 5/1988 | Schellenberg | |
| 4,782,977 | A | 11/1988 | Watanabe et al. | |
| 4,785,963 | A | 11/1988 | Magley | |
| 4,787,552 | A * | 11/1988 | Natori | 220/4.23 |
| 4,819,824 | A * | 4/1989 | Longbottom et al. | 220/266 |
| 4,881,656 | A | 11/1989 | Chumley et al. | |
| 4,930,656 | A | 6/1990 | Blanchette | |
| 4,966,292 | A | 10/1990 | Marino et al. | |
| 4,974,735 | A | 12/1990 | Newell | |
| 4,990,345 | A | 2/1991 | Webb | |
| 5,002,198 | A | 3/1991 | Smith | |
| 5,007,231 | A | 4/1991 | Ingemann | |
| 5,027,969 | A | 7/1991 | Lesquir | |
| 5,040,695 | A | 8/1991 | Adams et al. | |
| 5,052,572 | A | 10/1991 | Pherigo | |
| 5,092,479 | A * | 3/1992 | Wells | 220/4.23 |
| 5,111,953 | A | 5/1992 | Faust et al. | |
| 5,111,954 | A | 5/1992 | Gaudreault | |
| 5,115,934 | A | 5/1992 | Nelson | |
| 5,129,531 | A | 7/1992 | Beck et al. | |
| 5,131,551 | A * | 7/1992 | Wells | 220/4.23 |
| 5,133,470 | A | 7/1992 | Abrams et al. | |
| 5,163,575 | A | 11/1992 | Luch et al. | |
| 5,170,905 | A | 12/1992 | Luch | |
| 5,219,087 | A | 6/1993 | Christensson | |
| 5,249,694 | A | 10/1993 | Nelson | |
| 5,251,758 | A | 10/1993 | Kolacek | |
| 5,283,940 | A | 2/1994 | Luch et al. | |
| 5,300,748 | A | 4/1994 | Colombo | |
| 5,303,839 | A | 4/1994 | Blumenschein | |
| 5,307,948 | A | 5/1994 | Blackburn et al. | |
| 5,437,386 | A | 8/1995 | Von Holdt | |
| 5,507,406 | A * | 4/1996 | Urciuoli et al. | 220/269 |
| 5,511,679 | A | 4/1996 | Beck | |
| 5,528,814 | A | 6/1996 | Luch et al. | |
| 5,573,134 | A | 11/1996 | Chenault et al. | |
| 5,626,251 | A | 5/1997 | Luburic et al. | |
| 5,772,110 | A | 6/1998 | Garretson | |
| 5,785,203 | A | 7/1998 | Arshinoff et al. | |
| 5,788,105 | A | 8/1998 | Foos | |
| 5,871,147 | A | 2/1999 | Smith et al. | |
| 5,875,913 | A | 3/1999 | Letica | |
| 5,890,648 | A | 4/1999 | Cai | |
| 5,931,291 | A | 8/1999 | Sedon et al. | |
| 5,931,332 | A | 8/1999 | Mygatt et al. | |
| 5,979,690 | A | 11/1999 | Hartley | |
| 6,000,570 | A | 12/1999 | Nelson | |
| 6,045,038 | A | 4/2000 | Smith et al. | |
| RE36,729 | E | 6/2000 | Luch et al. | |
| 6,076,698 | A | 6/2000 | Magidson | |
| 6,116,450 | A | 9/2000 | Huang | |
| 6,193,921 | B1 | 2/2001 | Nelson | |
| 6,257,435 | B1 | 7/2001 | Chedister et al. | |
| 6,279,774 | B1 | 8/2001 | Clute et al. | |
| 6,328,355 | B1 | 12/2001 | Bortz | |
| 6,491,164 | B1 | 12/2002 | Virvo | |
| 6,572,909 | B1 | 6/2003 | Bagwell et al. | |
| 6,604,645 | B1 | 8/2003 | Vaupotic | |
| 6,604,646 | B2 | 8/2003 | Torniainen et al. | |
| 6,877,631 | B1 | 4/2005 | Thompson et al. | |
| 6,899,245 | B1 | 5/2005 | Nelson | |
| 7,004,314 | B2 | 2/2006 | Pucillo et al. | |
| 7,073,680 | B2 * | 7/2006 | Boback et al. | 220/266 |
| 7,097,043 | B2 | 8/2006 | Hsu | |
| 7,118,003 | B2 | 10/2006 | Sellari et al. | |
| 7,140,211 | B2 | 11/2006 | Tremblay | |
| 7,172,109 | B2 | 2/2007 | Kuentseler et al. | |
| 7,235,207 | B2 | 6/2007 | Gregory et al. | |
| 7,311,218 | B2 | 12/2007 | Varadarajan | |
| 7,325,676 | B2 | 2/2008 | Galaz | |
| 7,661,547 | B2 | 2/2010 | Richir | |
| 7,694,837 | B2 | 4/2010 | Robertson et al. | |
| 7,757,848 | B2 | 7/2010 | Gelardi et al. | |
| 8,056,750 | B2 | 11/2011 | Vovan et al. | |
| 8,123,064 | B2 | 2/2012 | Vovan et al. | |
| 8,127,961 | B2 | 3/2012 | Vovan et al. | |
| 8,146,766 | B2 | 4/2012 | Vovan et al. | |
| 2002/0088814 | A1 | 7/2002 | Belfance | |
| 2002/0170914 | A1 | 11/2002 | Witt | |
| 2003/0029868 | A1 | 2/2003 | Davidov et al. | |
| 2003/0127419 | A1 | 7/2003 | Shenkar et al. | |
| 2003/0160051 | A1 | 8/2003 | Ciccone | |
| 2003/0189048 | A1 | 10/2003 | Luburic | |
| 2004/0026286 | A1 * | 2/2004 | Ramsey | 206/431 |
| 2004/0045867 | A1 | 3/2004 | Appelbaum | |
| 2004/0094548 | A1 | 5/2004 | Laveault | |
| 2004/0108370 | A1 | 6/2004 | Lee | |
| 2004/0118848 | A1 | 6/2004 | Marshall | |
| 2004/0200839 | A1 | 10/2004 | Conti | |
| 2004/0200891 | A1 | 10/2004 | Correll | |
| 2005/0017007 | A1 | 1/2005 | Sellari et al. | |
| 2005/0061861 | A1 | 3/2005 | Pennino | |
| 2005/0145628 | A1 | 7/2005 | Schwarz | |
| 2005/0161455 | A1 | 7/2005 | Studee | |
| 2005/0173435 | A1 | 8/2005 | Wellman et al. | |
| 2005/0184070 | A1 | 8/2005 | Boback et al. | |
| 2005/0236413 | A1 | 10/2005 | Maciag et al. | |
| 2005/0252916 | A1 | 11/2005 | Varadarajan | |
| 2006/0003879 | A1 | 1/2006 | Buchman | |
| 2006/0006178 | A1 | 1/2006 | Foldesi et al. | |
| 2006/0011632 | A1 | 1/2006 | Caille | |
| 2006/0016821 | A1 | 1/2006 | Liu | |
| 2006/0144874 | A1 | 7/2006 | Solowiejko | |
| 2006/0163265 | A1 | 7/2006 | De Candido | |
| 2006/0201946 | A1 | 9/2006 | Witt | |
| 2006/0261070 | A1 | 11/2006 | Robertson et al. | |
| 2006/0266750 | A1 | 11/2006 | Lesquir | |
| 2006/0289541 | A1 | 12/2006 | Boback et al. | |
| 2006/0289549 | A1 | 12/2006 | Vovan | |
| 2007/0062948 | A1 | 3/2007 | Albrecht et al. | |
| 2007/0095848 | A1 | 5/2007 | Galland et al. | |
| 2007/0108210 | A1 | 5/2007 | Alvares et al. | |
| 2007/0138180 | A1 | 6/2007 | Vovan | |
| 2007/0164026 | A1 | 7/2007 | Morrissey et al. | |
| 2007/0202221 | A1 | 8/2007 | Hinze et al. | |
| 2008/0000904 | A1 | 1/2008 | Vovan | |
| 2008/0006632 | A1 | 1/2008 | Vovan | |
| 2008/0185383 | A1 | 8/2008 | Philippe et al. | |
| 2008/0199108 | A1 | 8/2008 | Rogers | |
| 2009/0021026 | A1 | 1/2009 | Collier | |
| 2009/0032545 | A1 | 2/2009 | Zeiler et al. | |
| 2009/0057313 | A1 | 3/2009 | Alvares | |
| 2009/0120936 | A1 | 5/2009 | Zauser et al. | |
| 2009/0120942 | A1 | 5/2009 | Vovan | |

FOREIGN PATENT DOCUMENTS

| | | |
|---|---|---|
| DE | 29819718 | 1/1999 |
| DE | 29914659 | 8/1999 |
| EP | 0752374 | 1/1997 |
| EP | 1 736 417 B1 | 1/2008 |
| FR | 2 691 952 A1 | 12/1993 |
| FR | 2 819 496 A1 | 7/2002 |

(56) References Cited

FOREIGN PATENT DOCUMENTS

| | | |
|---|---|---|
| GB | 2257118 | 1/1993 |
| WO | WO 2005/082733 | 9/2005 |
| WO | WO 2005/082734 | 9/2005 |

OTHER PUBLICATIONS

U.S. Appl. No. 11/879,168, Amendment dated Sep. 14, 2010.
U.S. Appl. No. 11/879,168, Sep. 27, 2011 Issue Fee paid.
U.S. Appl. No. 12/075,549, Oct. 18, 2011 Response to Non-Final Office Action.
U.S. Appl. No. 12/220,017, Oct. 19, 2011 Non-Final Office Action.
U.S. Appl. No. 11/879,168, Jun. 27, 2011 Notice of Allowance.
U.S. Appl. No. 11/879,168, Jun. 10, 2011 Notice of Appeal.
U.S. Appl. No. 11/879,168, Jun. 9, 2011 Amendment after Final.
U.S. Appl. No. 11/857,144, Sep. 21, 2011 Response to Final Office Action.
U.S. Appl. No. 11/857,144, Jun. 21, 2011 Final Office Action.
U.S. Appl. No. 12/327,759, Aug. 11, 2011 Final Office Action.
U.S. Appl. No. 12/432,627, Jul. 29, 2011 Non-Final Office Action.
U.S. Appl. No. 12/432,627, Jul. 15, 2011 Amendment after Notice of Allowance and Request for Continued Examination (RCE).
U.S. Appl. No. 12/075,549, Jul. 22, 2011 Non-Final Office Action.
U.S. Appl. No. 12/220,017, Jan. 19, 2012 Response to Non-Final Office Action.
U.S. Appl. No. 12/075,549, Jan. 27, 2012 Issue Fee payment.
U.S. Appl. No. 11/857,144, Jan. 19, 2012 Issue Fee payment.
U.S. Appl. No. 12/220,017, filed Jul. 21, 2008.
U.S. Appl. No. 11/879,168, filed Jul. 16, 2007.
U.S. Appl. No. 11/857,144, filed Sep. 18, 2007.
U.S. Appl. No. 12/432,627, filed Apr. 29, 2009.
U.S. Appl. No. 12/075,549, filed Mar. 12, 2008.
U.S. Appl. No. 12/327,759, filed Dec. 3, 2008.
U.S. Appl. No. 11/879,168, Apr. 26, 2011 Advisory Action.
U.S. Appl. No. 11/879,168, Mar. 10, 2011 Response to Final Office Action.
U.S. Appl. No. 11/879,168, Dec. 10, 2010 Final Office Action.
U.S. Appl. No. 11/857,144, Apr. 7, 2011 Response to Non-Final Office Action.
U.S. Appl. No. 11/857,144, Jan. 7, 2011 Non-Final Office Action.
U.S. Appl. No. 12/432,627, Apr. 15, 2011 Notice of Allowance.
U.S. Appl. No. 12/432,627, Mar. 25, 2011 Response to Final Office Action.
U.S. Appl. No. 12/432,627, Jan. 26, 2011 Final Office Action.
U.S. Appl. No. 12/432,627, Dec. 22, 2010 Response to Non-Final Office Action.
U.S. Appl. No. 12/432,627, Aug. 24, 2010 Non-Final Office Action.
U.S. Appl. No. 12/432,627, Aug. 9, 2010 Response to Restriction Requirement.
U.S. Appl. No. 12/432,627, Jul. 8, 2010 Restriction Requirement.
U.S. Appl. No. 12/327,759, Apr. 21, 2011 Response to Non-Final Office Action.
U.S. Appl. No. 12/327,759, Jan. 21, 2011 Non-Final Office Action.
U.S. Appl. No. 12/220,017, May 25, 2012 Final Office Action.
U.S. Appl. No. 12/220,017, Sep. 25, 2012 Notice of Allowance.

* cited by examiner

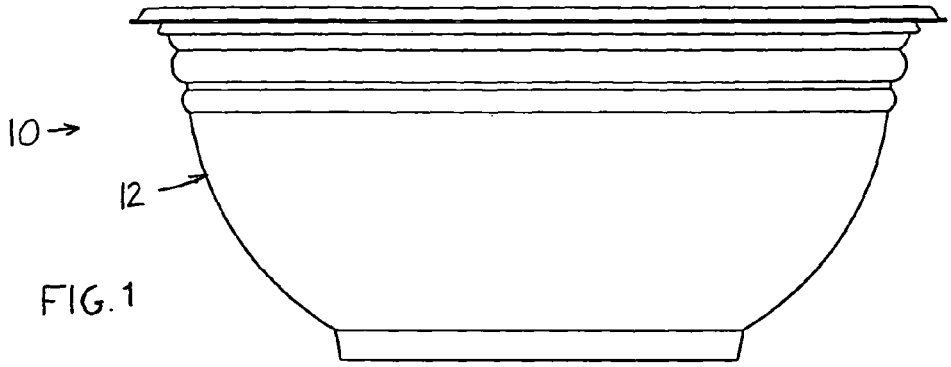
FIG. 1
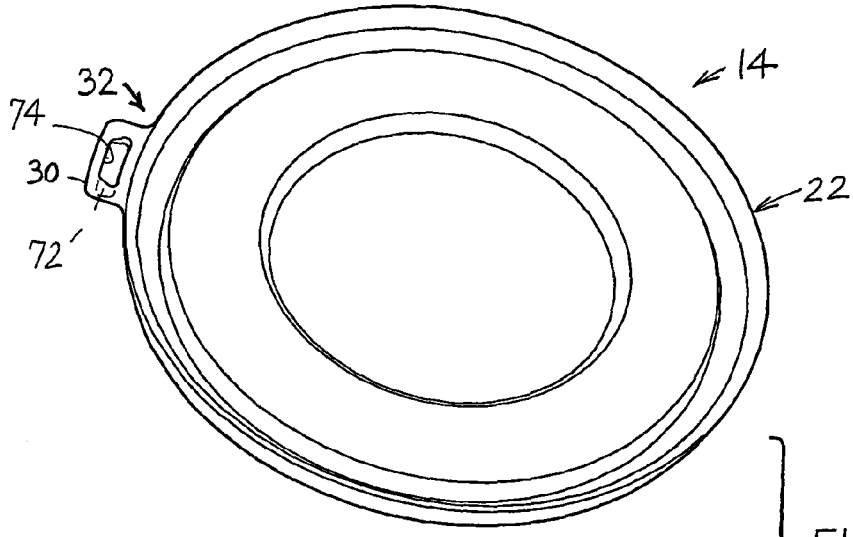
FIG. 2
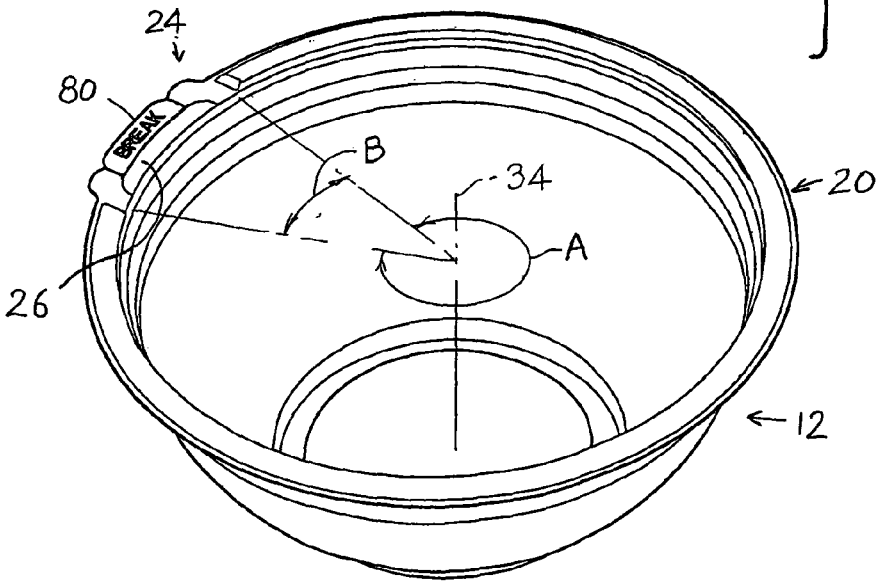

137
134

132
136
138
130
144
G
140
136
140a
BREAK
138
140b
142
146

ENHANCED TAMPER EVIDENT BOWL WITH BLOCKED TAB

BACKGROUND OF THE INVENTION

Food is often placed in a transparent plastic container that includes a base with a large volume cavity that holds the food and with a cover or lid that closes the cavity. Buyers want to be assured that, after the food was placed in the container as by a clerk at the food store, that the container has not been opened. There is a possibility that another customer has secretly opened the container enough to taste a bit of the food before closing it (and possibly leaving germs from his/her finger in the food). Potential buyers want to be assured that this has not happened. A container constructed by the container manufacturer that allowed a clerk at the store to automatically activate a device that clearly indicated to a potential customer whether or not the container has been opened since it was first closed by the clerk, would be of value.

SUMMARY OF THE INVENTION

In accordance with one embodiment of the invention, a container is provided of the type that includes a base and lid, which allows the lid to be closed and thereafter prevents the lid from being opened unless a barrier is broken. The container and lid each have trapping portions and pull-open portions with a tear-open barrier on the base of the pull-open portion. The tear-tab, or tear-open barrier forms the upper wall of a horizontal slot. The pull-open portion of the lid has a pull-up tab that is projected through the slot when the lid is closed. When the lid is closed the trapping portion of the base traps the lid in the closed position and prevents the lid from opening unless the pull-open side of the lid is pulled up. To open the lid, the barrier must be broken, so the pull-up tab on the lid can be pulled up to release the lid from the base.

The trapping side of the base has a trapping wall that extends at a downward-outward incline (with respect to the container axis) and has a stop wall that extends radially inward from the bottom of the trapping wall. The lid has a peripheral lip that can be pressed down along the trapping wall until the lip reaches the stop wall. The lip then cannot be raised so the lid is trapped in the closed position until the barrier is torn so the pull-up tab can be pulled up.

The base has a seal wall lying below the stop wall, the seal wall having a concave radially inner surface that extends at a downward-inward incline. The lid has a corresponding seal wall with a convex outer surface that lies facewise against the concave surface of the base to form a fluid tight seal.

The novel features of the invention are set forth with particularity in the appended claims. The invention will be best understood from the following description when read in conjunction with the accompanying drawings.

DESCRIPTION OF THE DRAWINGS

FIG. 1 is a side elevation view of a container of the invention, with the lid closed on the base.

FIG. 2 is an exploded isometric view of the base and lid of the container of FIG. 1.

DESCRIPTION OF THE PREFERRED EMBODIMENTS

Figure 3:
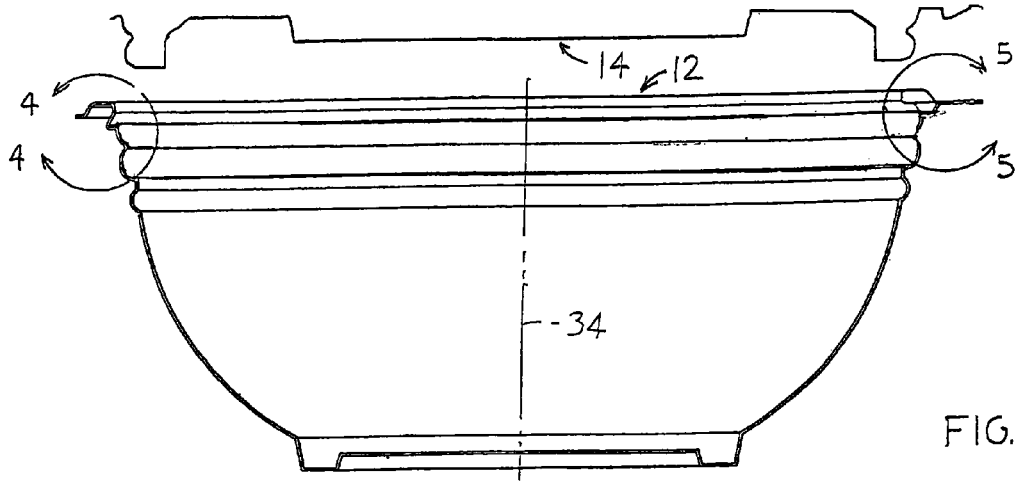
FIG. 3 is an exploded sectional side view of the container of FIG. 1.

FIGS. 1 and 2 show a bowl-shaped container 10 of the invention, which includes a base 12 and a lid 14 that can be closed on the base. The base and lid are constructed of plastic sheeting which has been deformed as by vacuum forming. The particular base and lid of FIG. 1 are formed to two pieces of plastic sheet. The base has a trapping side or portion 20 that receives a trapping portion 22 of the lid and thereafter resists lid removal. The base also has a pull-open side or portion 24 with a horizontally open slot 26 that receives a lift tab, or pull-up tab 30 of a pull-open or pull-out portion 32, or section, of the lid. The trapping portions or sections of the base and lid extend at an angle A of at least 3000 around the vertical axis 34 of the closed container. The trapping portion could extend 360°. The pull-open portions of the base and lid extend by an angle B that is preferably less than 90° around the axis.

Figure 6:
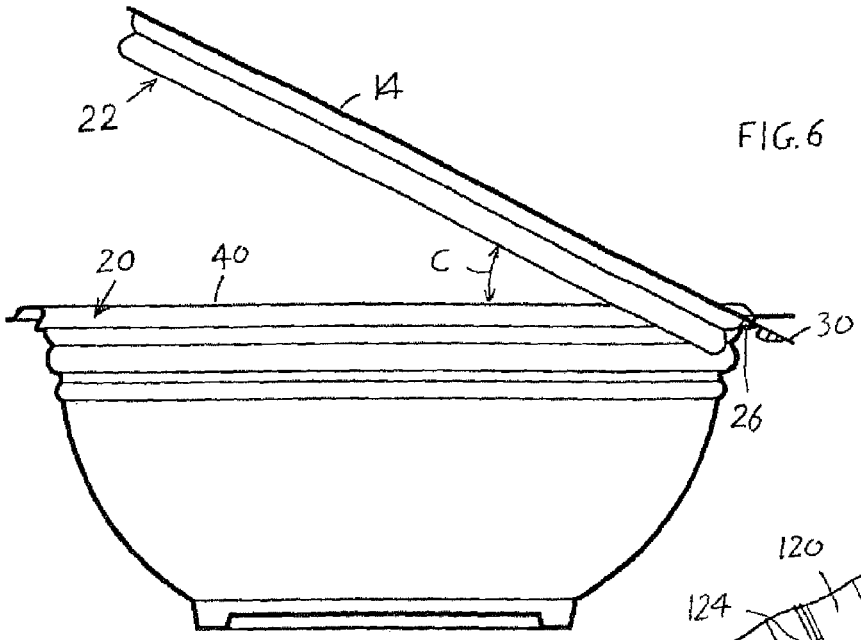
FIG. 6 is a side view of the container of FIG. 3, with the base shown in section and the lid shown in elevation, showing the tab of the lid being projected though a slot in the base, during first closing of the container.
Figure 7:
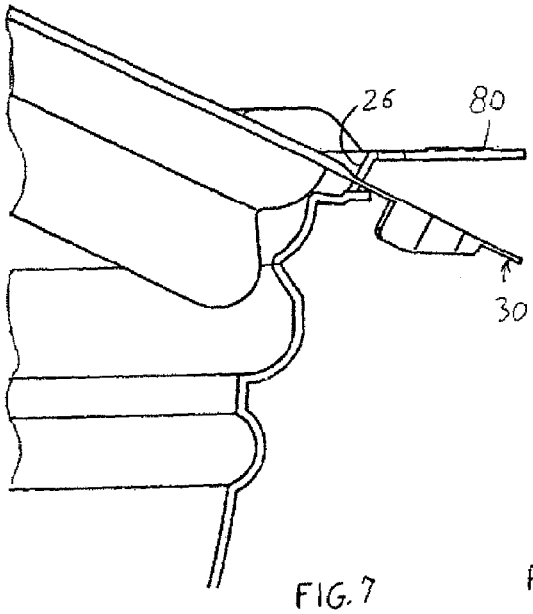
FIG. 7 is an enlarged view of an area of FIG. 6, showing the tab projected though the slot during the first closing of the container.

The lid is installed in the manner shown in FIG. 6, by holding the lid 14 at an incline C such as about 30° to the horizontal and to the top 40 of the base, and projecting the tab 30 of the lid through the slot 26 in the base. Then the trapping portion 22 of the lid is pushed down forcefully into the trapping portion 20 of the base. This results in the trapping portion of the lid being trapped in place deep in the base.

Figure 4:
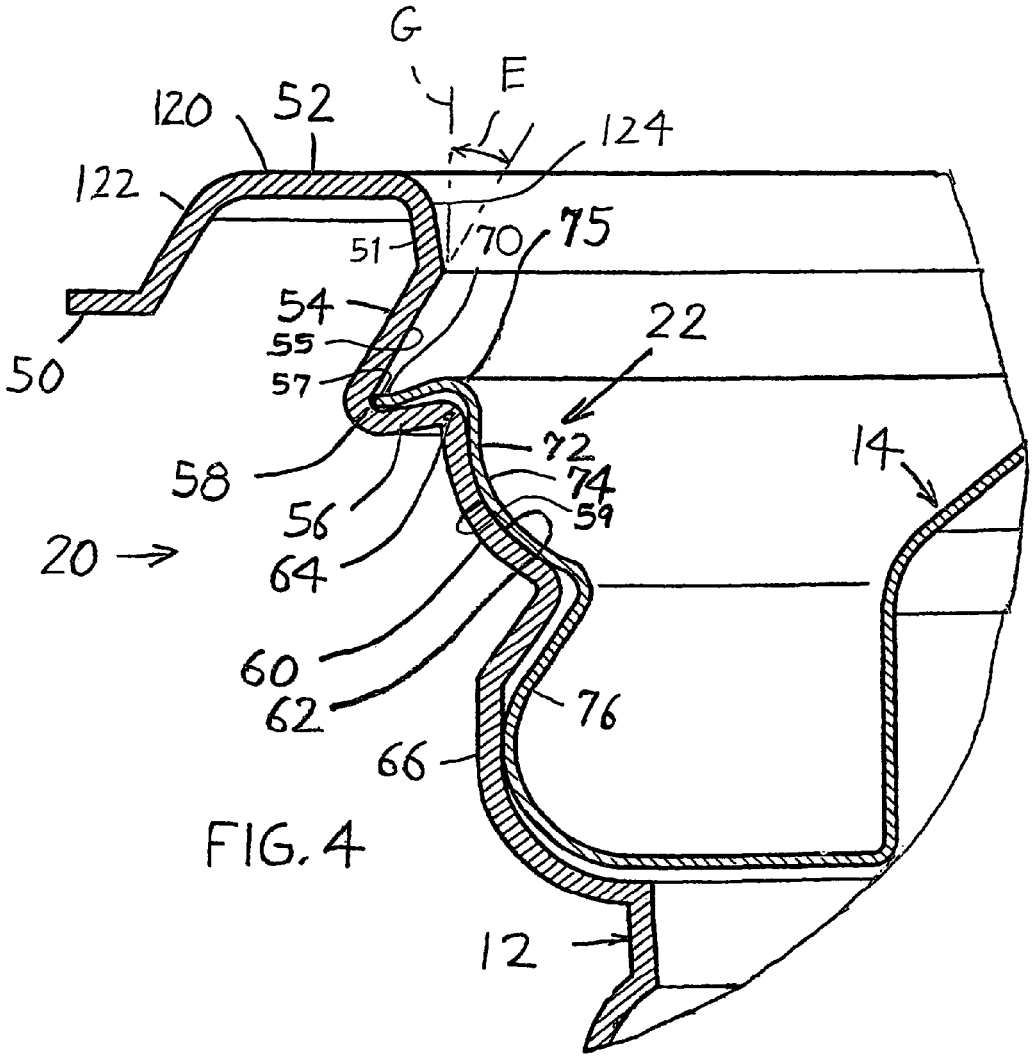
FIG. 4 is an enlarged sectional view of area 4-4 of FIG. 3, with the lid closed on the base.

FIG. 4 shows the trapping portions 20, 22 of the base and lid in their fully trapped positions. The base has an outer edge part 50, and has an upward flange 52 extending radially inward of and above the base outer edge. The term "radially" describes a direction with respect to the axis 34 of the container, so "radially inward" or just "inward" means toward the axis and "radially outward" or just "outward" means away from the axis. Terms such as "inner" surface means the surface closest to the axis.

The base, or base element shown in FIG. 4 has a trapping wall 54 with an inside surface 55 extending at a downward and radially outward incline from the inside of flange 52, and has a stop wall 56 that lies at the bottom of the trapping wall. The stop wall extends primarily radially inward from the bottom of the primarily vertical trapping wall. The trapping wall is joined to the stop wall at a corner 58 that has an inside corner 57, and the stop wall extends primarily radially inward from the corner 58. The base element also has an upper seal wall 60 with a concave inner surface 62, that extends downward from a corner 64 at the inside of the stop wall. The base element has a lower seal wall 66. The lid, or lid element, has corresponding walls, including a radially outward free resilient peripheral lip 70, and an upper seal wall 72 with a convex outside surface 59 and with a concave inner surface 74. The surface 74 is joined to the lip by a large radius corner 75 whose radius is larger than that of the base corner 64. The lid element also has a lower seal wall 76. The inside radius of curvature of the lid corner 75 is at least 150% of the radius of curvature of the inside of the base corner 64. The lid element corner 75 is constructed to avoid contact with corner 64 to allow the peripheral lip 70 to contact walls of the base corner 57. Either element 12, 14 can be referred to as a first element or second element.

When the lid is pushed down forcefully into the base, the peripheral lip 70 of the lid snaps down to the position shown in FIG. 4, with the lip 70 lying at the bottom of the trapping wall 54, at the corner 58. The trapping wall 54 extends at a downward-outward incline from a vertical G, which is preferably between 5° and 30° to the vertical. The peripheral lip 70 is unreinforced so it readily bends up when pushed down along the inside of the trapping wall, and then is trapped in place. The peripheral lip 70 could be forcefully pulled up, but a person cannot firmly grasp the lip to pull it up, and it requires a large upward force to pull it up. It is easy to push down the lip into place but almost impossible to pull up the lip, unless the pull-open portion of the lid is first pulled up.

Figure 5:
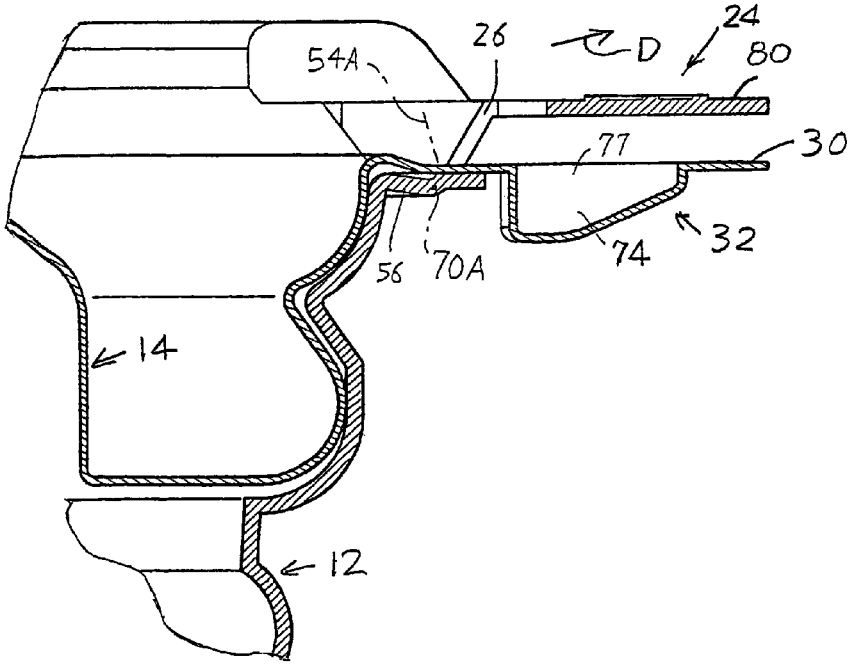
FIG. 5 is an enlarged sectional view of area 5-5 of FIG. 3, with the lid closed on the base.

FIG. 5 shows the pull-open portions 24, 32 of the base and lid when the lid has been fully closed on the base. The point 70A represents a location of the same height and radial position where the peripheral lip of the lid would lie at the bottom of the trapping wall at 54A, in the trapping portion of the container. Instead, the pull-open portion of the lid forms the lift tab 30, which projects primarily radially outward through the slot 26 in the pull-open portion of the base. The position otherwise occupied by a trapping wall 54A on the base is devoid of the trapping wall along the pull-open portion. Instead, the base has a tear-tab, or barrier wall, or barrier 80 that forms the upper wall of the slot 26 in the base. The lid forms the pull-up tab 30 that projects primarily radially though the slot 26. The slot 26 has a small enough height and the tab 30 has a sufficient radial length and has stiffeners 77 formed beside a opening 74 in the tab, that a person normally cannot bend the tab and push it inwardly to lie inward of the slot 26 to raise the tab. Instead, the only practical way for a person to raise the tab is to tear away the barrier 80. The opening 74 is in the form of a blind hole.

Figure 8:
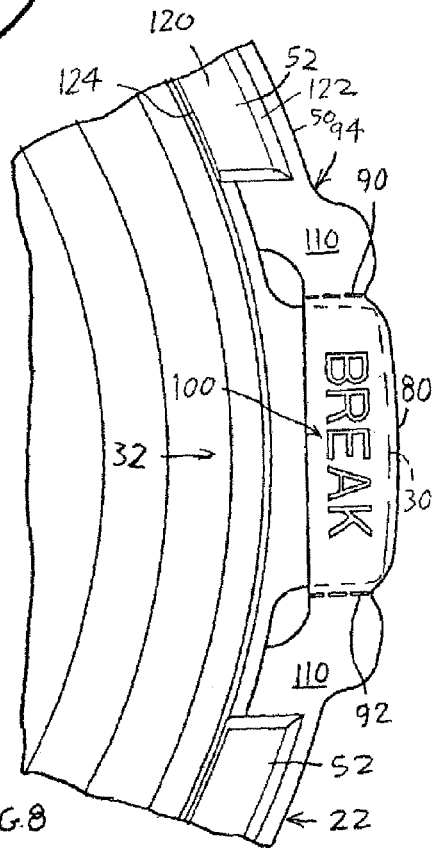
FIG. 8 is a plan view of the area of the container of FIG. 7, after the lid has been fully closed.

FIG. 8 shows that the barrier 80 is attached by two tear joints 90, 92 to a major portion 94 of the base, which is primarily the trapping portion of the base. The tear joints, which extend perpendicular to adjacent parts of the edge 50, are weakened by perforations, notches or by a groove passing partway though the sheet at each tear joint. The barrier has an indication 100, formed by the word "BREAK" that indicates that the barrier should be broken. Upon breaking the barrier 80 at one or both joints, the lift tab 30 can be lifted. When the lift tab is tilted by several degrees (preferably at least 15°) such as 20° or more, the lid can be pulled along the upwardly inclined direction D (FIG. 5) to remove the lid from the base. Once the barrier has been broken, the lid can be repeatedly closed and opened using only moderate force applied to the lift tab, and the container seals the contents each time the lid is closed.

FIG. 8 shows transition region 110 at opposite sides of the trapping portion 22 of the base. The plastic sheet of the base, which is vacuum formed, has a flat portion between the ends of the flange 52. The flange 52 forms the flange top part 120 and has opposite flange sides 122, 124 that strengthens the upper part of the base to support the weight of other similarly loaded containers that are stacked on one another. A circumferential gap in the flange that is much less than 90°, such as the gap of about 35° occupied by the pull-open portion 32, allows stable stacking of the containers. It can be seen that a first flange side (124) extends at an upward incline from a top of the trapping wall, the flange top part (120) extends at least partially radially outward from a top of the first flange side (124), and a second flange side (122) extends at a downward and radially outward incline from a radially outer end of the flange top part. This results in a loop at the base periphery that resists bending that might allow access to the lid tip 70. An outer edge part (50) of the periphery extends primarily radially outward from a bottom of the second flange side (122), and further resists access to the lid tip 70.

Figures 9, 10:
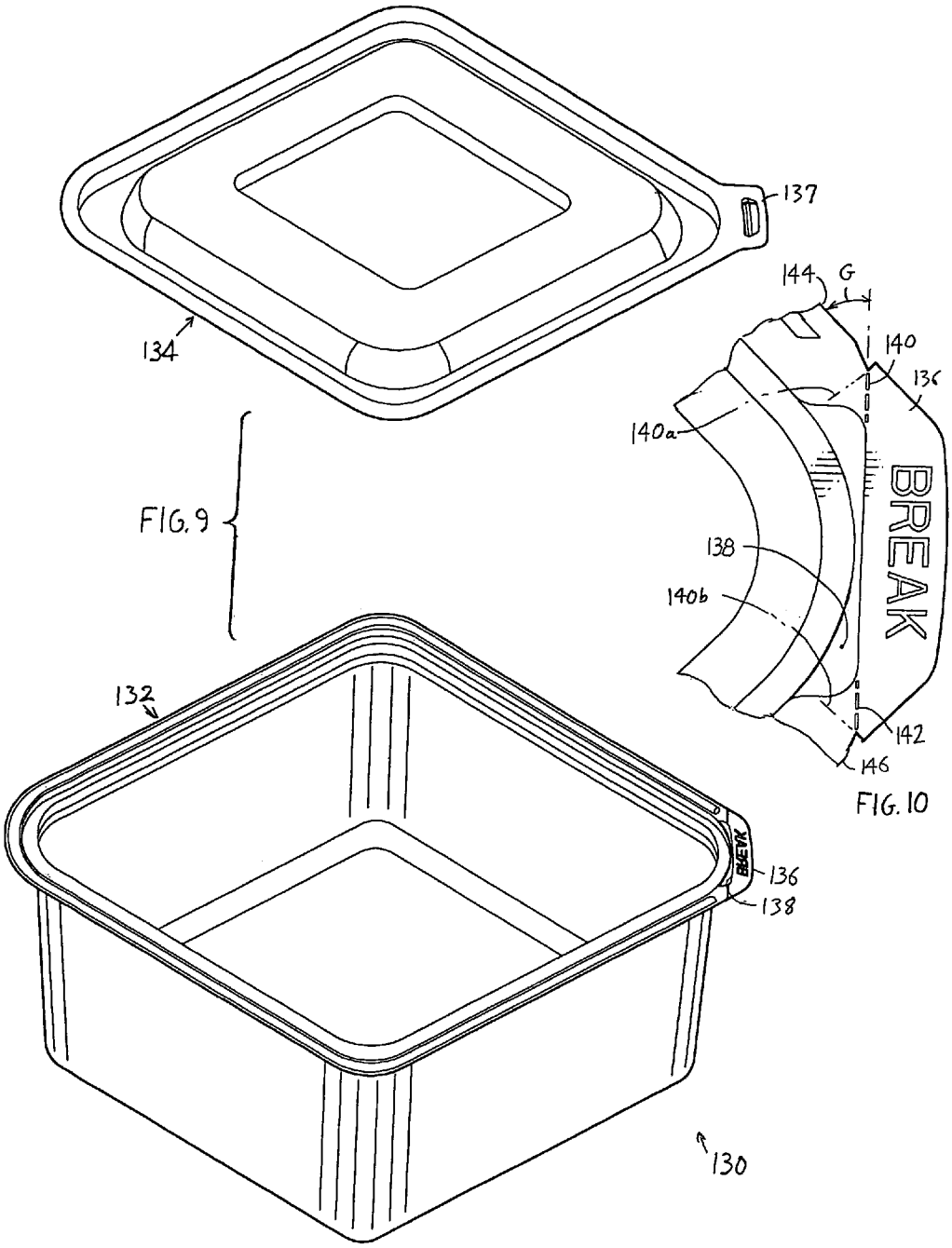
FIG. 9 is an exploded isometric view of another container of the invention, wherein the container is of a polygon shape instead of a bowl shape.
FIG. 10 is a partial plan view of the barrier of the base of the container of FIG. 9.

FIG. 9 shows another container 130 that is similar to the bowl-shaped container of FIGS. 1-8, but that has a regular polygon shape as seen in a plan view. The particular container shown is of square overall parallelepiped shape. The container 130 has a base 132 and lid 134 similar to that of the bowl-shaped container, except that the barrier 136 lies at one corner of the square shape. The lid has a pull-up tab 137 that fits in a slot 138 under the tear-tab barrier 136. FIG. 10 shows that the break lines 140, 142 of the barrier wall extend at angle G of about 45° (which is a plurality of degrees less than 90°) to adjacent sides 144, 146 of the square. If the break lines were positioned at 140*a*, 142*a* where they extended perpendicular to the sides, then this would result in projecting sharp corners, when the barrier 136 was torn off, which might hurt a person.

Figure 11:
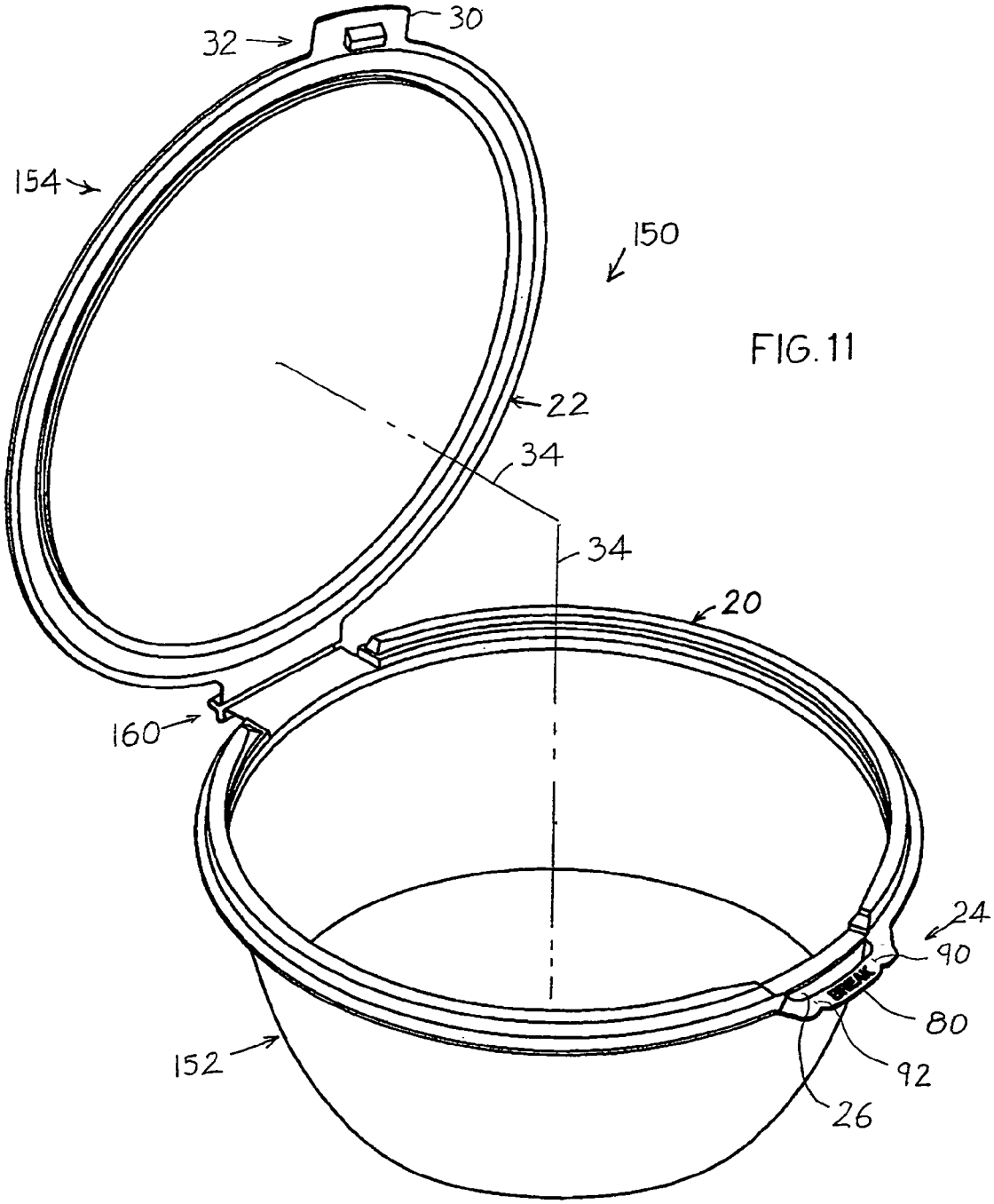
FIG. 11 is a perspective view of another exemplary container, with the lid in an open position.

FIG. 11 illustrates another container 150 that has a shape and construction similar to the bowl of FIGS. 1-8, but wherein the base 152 and lid 154 can be formed of a single piece of sheet plastic. The base and lid are joined by a hinge portion 160. The base and lid have pull open sections 24, 32 and trapping sections 20, 22, of the same construction as the container of FIGS. 1-8.

Figure 12:
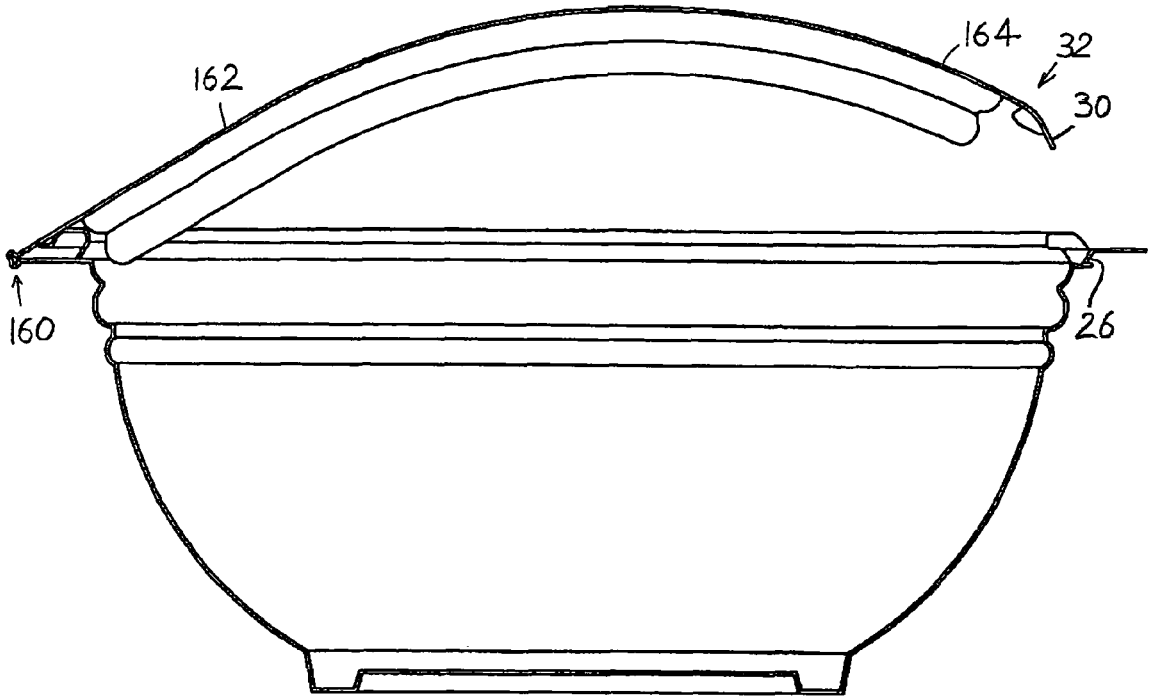
FIG. 12 is a side view of the container of FIG. 11, with the lid extending upward away from the hinge and forming a bend.
Figure 13:
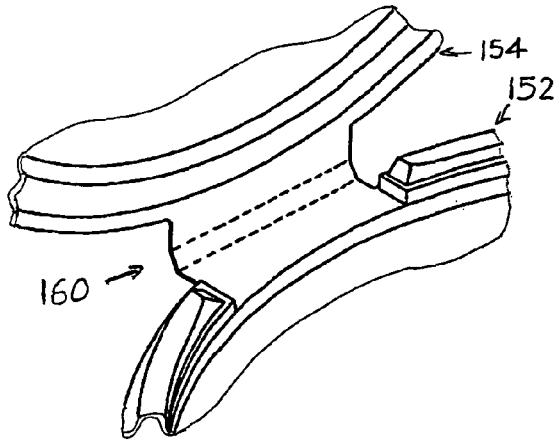
FIG. 13 is an enlarged view of a portion of FIG. 11, illustrating a hinge joining the base to the lid.

FIG. 12 shows the lid with one lid side 162 extending at an upward incline of about 30° away from the hinge 160, and with the lid being bent-so its opposite side 164 which is nearest the pullout section 32 extending horizontally or at a downward incline away from the hinge. This shortens the distance from the hinge 160 to the lift tab 30, sufficiently for the lift tab to be inserted through the slot 26. The trapping section 22 (FIG. 11) of the lid is pressed down into the trapping section 20 of the base. Thereafter, the lid can be opened only by tearing one or both tear joints 90, 92, followed by lifting the lift tab 30. FIG. 13 shows one possible construction of the hinge 160 which joins the base 152 to the lid 154.

Thus, the invention provides a container with a base and lid, which enables a store clerk to close the container the first time, after loading food or other goods in the base, and which then prevents the container from being opened without breaking at least one end of a barrier. Of course, the fact that the barrier has been broken is obvious to any customer, so if the customer sees that the tear-open barrier is not broken the customer will be assured that the container has not been opened. The container has trapping and pull-open portions or sections. The trapping section allows the lid to be forced down to a fully installed position and thereafter prevents the lid from being pulled up unless the pull-open section has been lifted and preferably also pulled away slightly from the center of the trapping portion. The container forms a seal around the entire container circumference, which is broken only when the pull-up tab is pulled up.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container having a first and a second element wherein one of the first and second elements is a base element and the other is a lid element, wherein each of said first and second elements is formed of at least one deformed sheet plastic, and further wherein when said first and second elements are aligned on a vertical axis said first and second elements each has a trapping section and a pull-open section with said trapping section of said first element having a trapping wall that allows the trapping section of the second element to be pushed down to an installed position and then resist the trapping section of the second element from being pulled up, wherein:

said pull-open section of said first element forms a primarily horizontally-opening slot and forms a barrier wall at the top of said slot, said first element having a major portion that includes said trapping section and circumferentially opposite sides of said pull-open section;

said pull-open section of said second element has a primarily horizontally-projecting pull-up tab that projects at least partially through said slot under said barrier wall when in said installed position so as not to be pulled up without removing said barrier wall from a location directly above said pull tab;

said barrier wall having at least one part joined to said major portion of said first element by a breakable joint, and removal of the barrier wall from above said pull tab requires breaking said joint.

2. The container described in claim 1 wherein:

said trapping wall of said first element trapping section has an inside surface that extends primarily downward, and said trapping section of said first element has a stop wall at the bottom of said trapping wall, the intersection of the bottom of said trapping wall and said stop wall forming an inside corner;

said trapping section of said second element has a resilient peripheral lip with an end that lies against and presses against said inside corner.

3. The container described in claim 1 wherein:

said first element forms a base corner at an intersection of an inner end of said stop wall and a top of an upper seal wall, and said lid element forms a lid corner at an intersection of said peripheral lip and a top of said lid element upper seal wall, said second element corner having an inside surface with at least 150% of the radius of curvature as an inside surface of said base element corner.

4. The container described in claim 1 wherein:

said first element has a top with a radially outer edge part, and with a flange portion lying radially inside said outer edge part, said flange portion having a primarily horizontally extending flange top lying above said outer edge part, and said flange portion having a primarily vertical flange outer wall extending down from an outer side of said top and having a primarily vertical flange inner wall extending down from an inner side of said flange down to the top of said trapping wall;

said flange portion being interrupted at said pull-open side of said first element so at said pull-open section the top of said base forms a horizontal wall of radial width at least equal to the radial width of said radially outer lip and forms said barrier wall.

5. The container described in claim 1 wherein:

said trapping section extends at least 300° about said axis.

6. The container described in claim 1 wherein:

said container has the shape of a regular polygon with a plurality of sides, as viewed in a plan view, and said barrier wall has opposite ends that each forms one of said breakable joints, said joints each extending a plurality of degrees less than 90° to an adjacent one of said sides.

7. The container described in claim 1 wherein:

said first and second elements are joined by a hinge lying at a side of the axis that is opposite said pull-open sections.

8. The container of claim 1, wherein the barrier wall is further joined to the major portion of the first element by a second breakable joint.

9. The container of claim 8, wherein the barrier wall is only joined to the major portion of the first element by the breakable joint and the second breakable joint.

10. The container of claim 1, wherein the breakable joint is perpendicular to an edge of the barrier wall adjacent the slot.

11. The container of claim 1, wherein the pull-open section of the first element is devoid of the trapping wall.

12. A container that includes a first element and a second element, each formed of deformed sheet plastic, wherein when said first and second elements are aligned on a vertical axis said second element fits at least partially into said first element with said first and second elements each having a trapping section that extends more than 180° about said vertical axis and a pull-open section that extends less than 180° about said vertical axis, wherein:

along said trapping section of said first element, said first element has a trapping wall that extends at a downward and radially outward incline, and said first element has a stop wall that extends inwardly from a bottom of said trapping wall;

along said trapping section of said second element, said second element has a radially outer peripheral lip that rests inside said trapping wall at the intersection of said trapping wall and said stop wall;

at said pull-open section of said first element, said first element has slot walls that form a radially-opening slot, said slot walls including an upper slot wall;

at said pull-open section of said second element, said second element forms a radially-outward projecting pull tab that extends through said slot when in an installed position;

said upper slot wall has circumferentially opposite ends that are constructed so at least one of the ends can be manually broken so said pull tab can be pulled up.

13. The container described in claim 12 wherein:

said pull tab has a horizontal upper surface with an opening therein, and said pull tab has largely vertical stiffeners extending downward from edge portions of said opening.

14. The container described in claim 12 wherein:

along said trapping section said first element has a top with an outer lip, and with a flange portion lying radially inside said lip and having a primarily horizontally-extending flange top and having inner and outer primarily vertically-extending flange walls said inner flange wall merging with the top of said trapping wall;

at intersections of said trapping region and said pull-open region, the top of said first element is devoid of said flange and forms a radially wide rim part.

15. The container described in claim 12 wherein: said first and second elements are joined by a hinge lying on a side of said axis which is opposite said pull-open sections of said first and second elements.

16. The container of claim 12, wherein the upper slot wall is attached to a major portion of the first element by a first tear joint and a second tear joint.

17. The container of claim 16, wherein the first tear joint and the second tear joint extend perpendicularly to an edge of the upper slot wall adjacent the slot.

18. The container of claim 12, wherein the pull-open section of the first element is devoid of the trapping wall.

* * * * *